US012060758B2

(12) United States Patent
Al-Farhan et al.

(10) Patent No.: US 12,060,758 B2
(45) Date of Patent: Aug. 13, 2024

(54) WASHOUT MITIGATION

(71) Applicant: Saudi Arabian Oil Company, Dhahran (SA)

(72) Inventors: AbdulHameed E. Al-Farhan, Al Markaz (SA); Hamzah A. Al-Khalifah, Al Mubarraz (SA); Fahmi Aulia, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 41 days.

(21) Appl. No.: 17/939,656

(22) Filed: Sep. 7, 2022

(65) Prior Publication Data

US 2024/0076947 A1 Mar. 7, 2024

(51) Int. Cl.
*E21B 23/14* (2006.01)
*E21B 23/02* (2006.01)

(52) U.S. Cl.
CPC ..... *E21B 23/14* (2013.01); *E21B 23/02* (2013.01)

(58) Field of Classification Search
CPC ..... E21B 23/02; E21B 23/14
See application file for complete search history.

(56) References Cited

U.S. PATENT DOCUMENTS 3,446,281 A * 5/1969 Watkins ..... E21B 23/02 166/216
4,082,144 A * 4/1978 Marquis ..... E21B 23/08 166/242.6
4,690,214 A * 9/1987 Wittrisch ..... E21B 47/01 166/308.1
4,842,064 A * 6/1989 Gazda ..... E21B 47/06 166/250.07
4,856,592 A * 8/1989 Van Bilderbeek ..... E21B 33/14 166/321
7,215,125 B2 * 5/2007 Clark ..... E21B 43/10 324/368

OTHER PUBLICATIONS

Al-Hajri et al., "Open hole washout maneuvering technology using coiled tubing," SPE-188109-MS, presented at the SPE Kingdom of Saudi Arabia Annual Technical Symposium and Exhibition, Dammam, Saudi Arabia, Apr. 2017, 10 pages.

* cited by examiner

*Primary Examiner* — D. Andrews
(74) *Attorney, Agent, or Firm* — Fish & Richardson P.C.

(57) ABSTRACT

One or more geometric dimensions of a portion of a washout section of a wellbore are determined. A retrievable tubular sleeve is run downhole through the casing string, such that a key profile disposed on an outer surface of the retrievable tubular sleeve connects with a landing nipple disposed on an inner surface of the casing string. The retrievable tubular sleeve is dimensioned such that, when the key profile is connected with the landing nipple, a portion of the retrievable tubular sleeve extends downhole from the downhole end of the casing string and within the portion of the washout section for which the one or more geometric dimensions have been determined, and an intervention or measurement tool can be run through the retrievable tubular sleeve through across the washout section.

13 Claims, 8 Drawing Sheets

WASHOUT MITIGATION

TECHNICAL FIELD

This disclosure relates to a method and system for well operations.

BACKGROUND

Hydrocarbons trapped in subsurface reservoirs are produced by first forming wellbores from the surface of the Earth to the subsurface reservoirs and then producing the trapped hydrocarbons through the wellbores to the surface. Wells for hydrocarbon production or other applications are completed and made ready for production by cementing a casing within the wellbore. In some instances, a washout section of the wellbore can form in an open-hole (uncased) or other portion of the wellbore. Such a washout section can prevent or complicate the running of intervention or measurement tools through the well or can otherwise adversely impact the efficiency, production, and/or safety of a well system or of drilling, intervention, or other downhole or surface operations.

SUMMARY

This disclosure relates to apparatus for mitigating the effects of a washout section on wellbore operations.

Certain aspects of the subject matter herein can be implemented as a method. The method includes determining one or more geometric dimensions of a portion of a washout section of a wellbore. The washout section extends at least partially downhole of a downhole end of a casing string cemented within the wellbore. The method further includes running, with a running tool, a retrievable tubular sleeve downhole through the casing string, thereby connecting a key profile disposed on an outer surface of the retrievable tubular sleeve with a landing nipple disposed on an inner surface of the casing string. The retrievable tubular sleeve is dimensioned such that, when the key profile is connected with the landing nipple, a portion of the retrievable tubular sleeve extends downhole from the downhole end of the casing string and within the portion of the washout section for which the one or more geometric dimensions have been determined. The method further includes running an intervention or measurement tool through the retrievable tubular sleeve into a portion of the wellbore below a downhole end of the washout section.

An aspect combinable with any of the other aspects can include the following features. The method can include removing the intervention or measurement tool from the wellbore removing the retrievable tubular sleeve from the casing string after the intervention or measurement tool has been removed from the wellbore.

An aspect combinable with any of the other aspects can include the following features. The one or more geometric dimensions determined can include a diameter of the wellbore at a point along a longitudinal axis of the wellbore within the washout section.

An aspect combinable with any of the other aspects can include the following features. The one or more geometric dimensions determined can include a length of the washout section along a longitudinal axis of the wellbore. The tubular sleeve can be dimensioned such that its downhole end is further downhole along a longitudinal axis of the wellbore than a downhole end of the washout section when the key profile is connected with the landing nipple.

An aspect combinable with any of the other aspects can include the following features. The retrievable tubular sleeve can be comprised of a metallic material.

An aspect combinable with any of the other aspects can include the following features. The landing nipple can include a releasable lock profile.

An aspect combinable with any of the other aspects can include the following features. The landing nipple can include a no-go profile.

An aspect combinable with any of the other aspects can include the following features. The retrievable tubular sleeve can be run downhole by coiled tubing.

An aspect combinable with any of the other aspects can include the following features. The retrievable tubular sleeve can be run downhole by a slickline.

An aspect combinable with any of the other aspects can include the following features. The retrievable tubular sleeve can be not cemented into the wellbore.

An aspect combinable with any of the other aspects can include the following features. An inner diameter of the retrievable tubular sleeve can be dimensioned so as to permit passage therethrough of an intervention tool.

An aspect combinable with any of the other aspects can include the following features. An inner diameter of the retrievable tubular sleeve can be dimensioned so as to permit passage therethrough of a logging tool.

An aspect combinable with any of the other aspects can include the following features. The method can include affixing the landing nipple to the casing string after the casing string has been cemented within the wellbore.

An aspect combinable with any of the other aspects can include the following features. The landing nipple can be affixed to the casing string before the casing string is disposed in the wellbore.

DETAILED DESCRIPTION

A method and system of mitigating a washout section of a well is disclosed. The installation of a retrievable tubular sleeve can enable or mitigate problems associated with the running and operation of intervention or measurement tools through a washout section, thus resulting in improved and more cost-effective well operations notwithstanding the presence of the washout section. Intervention tools and other apparatus (for example, logging, acid treatments, or other downhole operations) can be freely lowered downhole past a washout section using a retrievable sleeve, and the sleeve can then be easily retrieved as needed or desired for further wellbore operations.

Figure 1A:
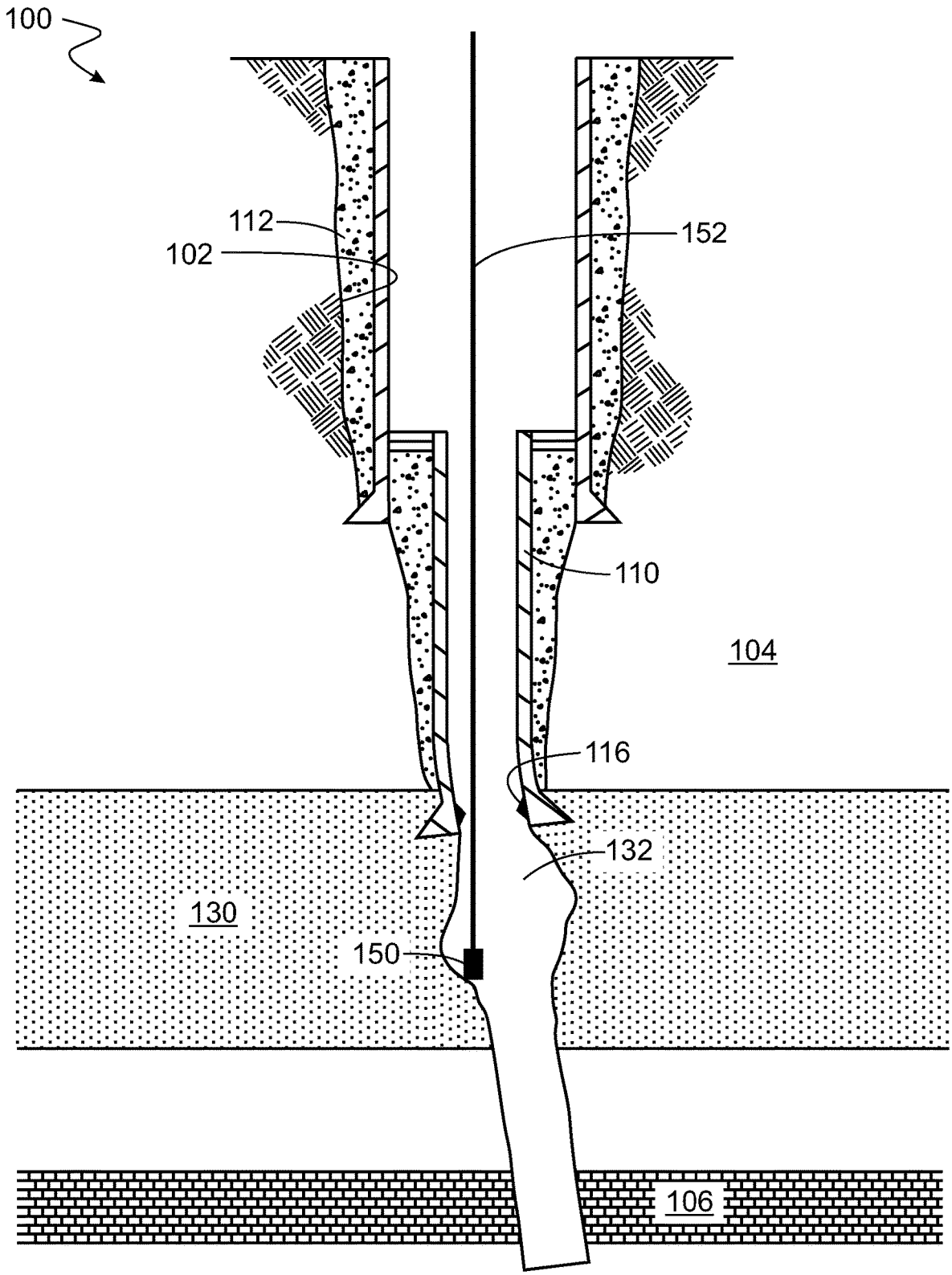
FIGS. 1A-1G are schematic drawings of a well system in accordance with an embodiment of the present disclosure.

FIGS. 1A-1G are schematic drawings of a well system in accordance with an embodiment of the present disclosure. Referring to FIG. 1A, well system 100 includes a wellbore 102 drilled into a subterranean zone 104. Subterranean zone 104 can comprise various geological formations of different geometries and lithologies, and in some instances are stacked or layered in sedimentary layers. In the illustrated embodiment, wellbore 102 has been drilled to a hydrocarbon producing zone 106 (such as a porous and permeable limestone or sandstone reservoir). In the illustrated embodiment, wellbore 102 is deviated well, in that, in some or all portions of the wellbore, the longitudinal axis of the wellbore deviates from vertical.

A casing string 110 comprising one or more casing segments has been cemented into a portion of the wellbore using conventional methods. Specifically, in accordance with such conventional methods, cement 112 has be pumped down the central bore of casing string 110 after each string segment has been positioned at its final depth. The cement 112 exits the bottom end of the respective casing string segments and travels upwards to fill the annulus between casing string 110 and wellbore 102. In the illustrated embodiment, a casing shoe 114 is disposed on the casing string 110, such that a downhole end of the casing string 110 is the downhole end of casing shoe 114. In some embodiments, no casing shoe is present, in which case the downhole end of casing string 110 can be the downhole end of the downhole-most segment of the string. A wiper plug or similar device (not shown) follows the cement, and displacement fluid (not shown) above the plug fills the central bore as the cement fills the annulus.

In the illustrated embodiment, on an interior surface of the casing string segment proximate the downhole end of casing string 110, a landing nipple 116 has installed. Landing nipple 116 can in some embodiments be installed on casing string 110 before casing string 110 is lowered into the wellbore. In some embodiments, landing nipple 116 can be affixed to casing string 110 after casing string 110 has been lowered and cemented within wellbore 102. Landing nipple 116 provides a seating surface on which one or more downhole components can be rested upon, latched, or otherwise connected.

In the illustrated embodiment, the portion of wellbore 102 downhole of casing shoe 114 is not cased. In some instances, subsequent completion operations would install further casing string segments to the downhole end of wellbore 102, which would then be perforated at the level of hydrocarbon producing zone 106 to allow for hydrocarbon production. In other instances, so as to minimize costs, increase fluid flow from across the production zone, or for other reasons, well system 100 can be completed as a so-called open-hole completion or barefoot completion, in which the portion of the wellbore 102 penetrating hydrocarbon producing zone 106 remains uncased during subsequent completion and production operations.

In some circumstances, an enlarged area, or washout, can form in the rock or other geological materials surrounding the wellbore. A washout section of the wellbore—that is, a zone of washout along a portion of the length of a wellbore—can be caused by excessive drill bit jet velocity, soft or unconsolidated formations, in-situ rock stresses, mechanical damage by bottomhole assembly components, chemical reactions, or other reasons. For example, in some circumstances, minerals such as anhydrite (anhydrous calcium sulfate) can dissolve or fragment in the presence of wellbore fluids.

In the illustrated embodiment, wellbore 102 passes through an anhydrite layer 130, and a washout section 132 has formed in an open-hole portion of wellbore 102 corresponding to all or part of anhydrite layer 130, at least partially downhole of the downhole end of casing string 110. Such washout sections can be problematic for well operations as it can cause wellbore fluid to undesirably flow into the formation, can complicate drilling, intervention, or other downhole operations, and/or can otherwise adversely impact the efficiency, production, and/or safety of a well system. For example, as shown in FIG. 1A, an intervention or measurement tool 150 has been lowered into the wellbore via a conveyance 152 (such as coiled tubing) with the intention of permanently or temporarily placing the tool at or near the production zone 106. However, because of the deviated geometry of wellbore 102 and the relative location, size, and shape of washout section 140, intervention or measurement tool 150 strikes an inner surface of the washout section, preventing intervention or measurement tool 150 from traveling further than the washout section.

Figure 1B:
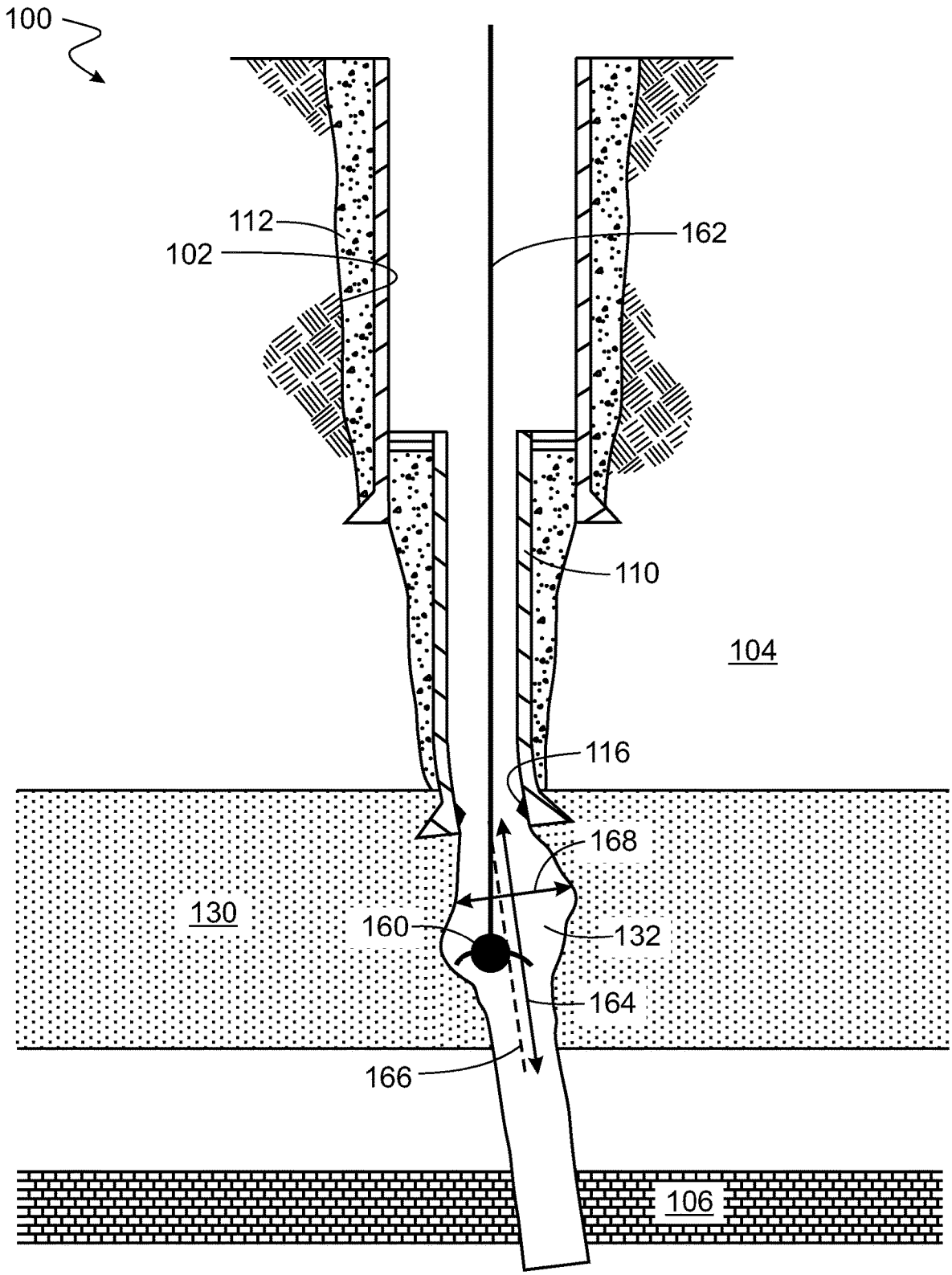
Figure 1C:
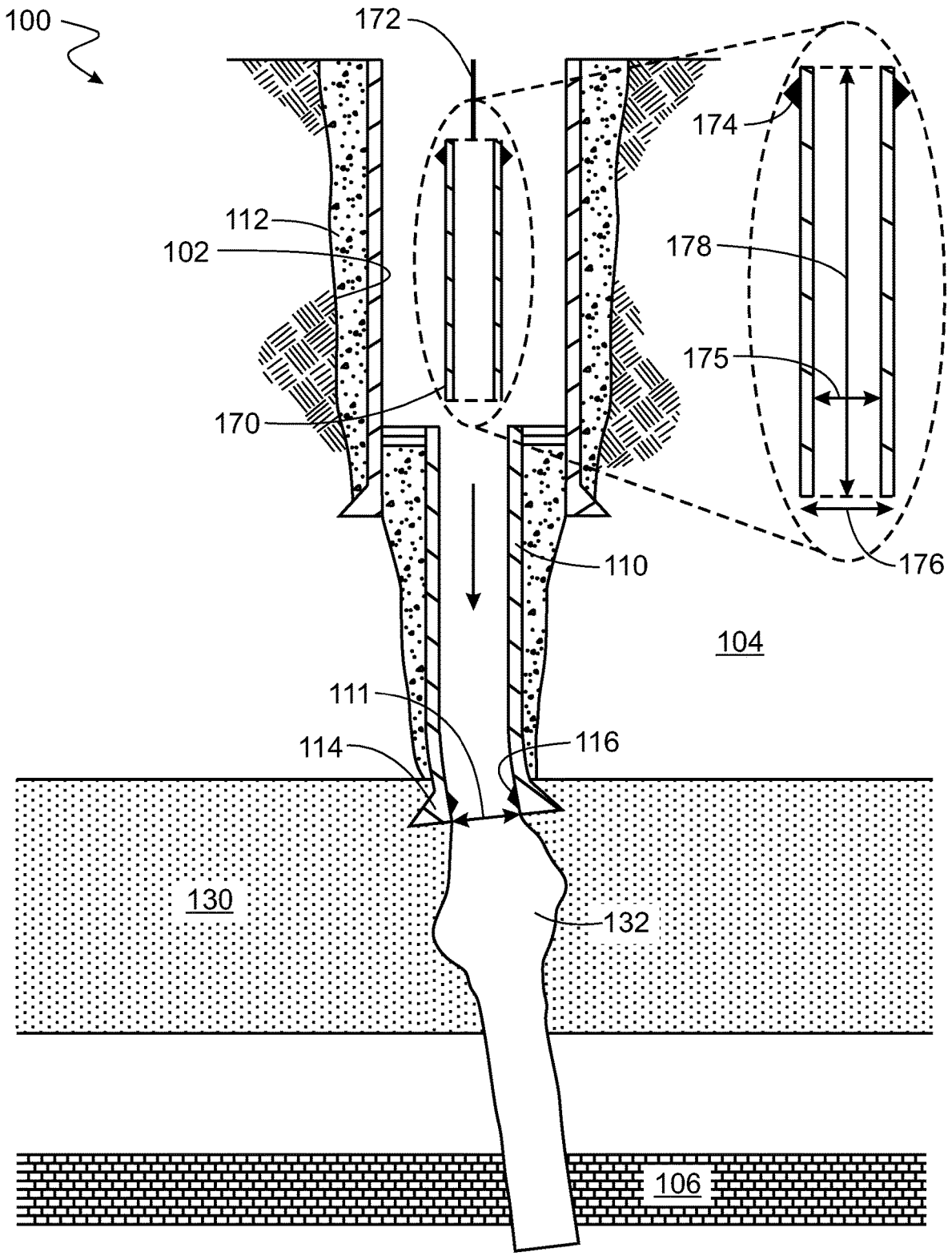
Figure 1D:
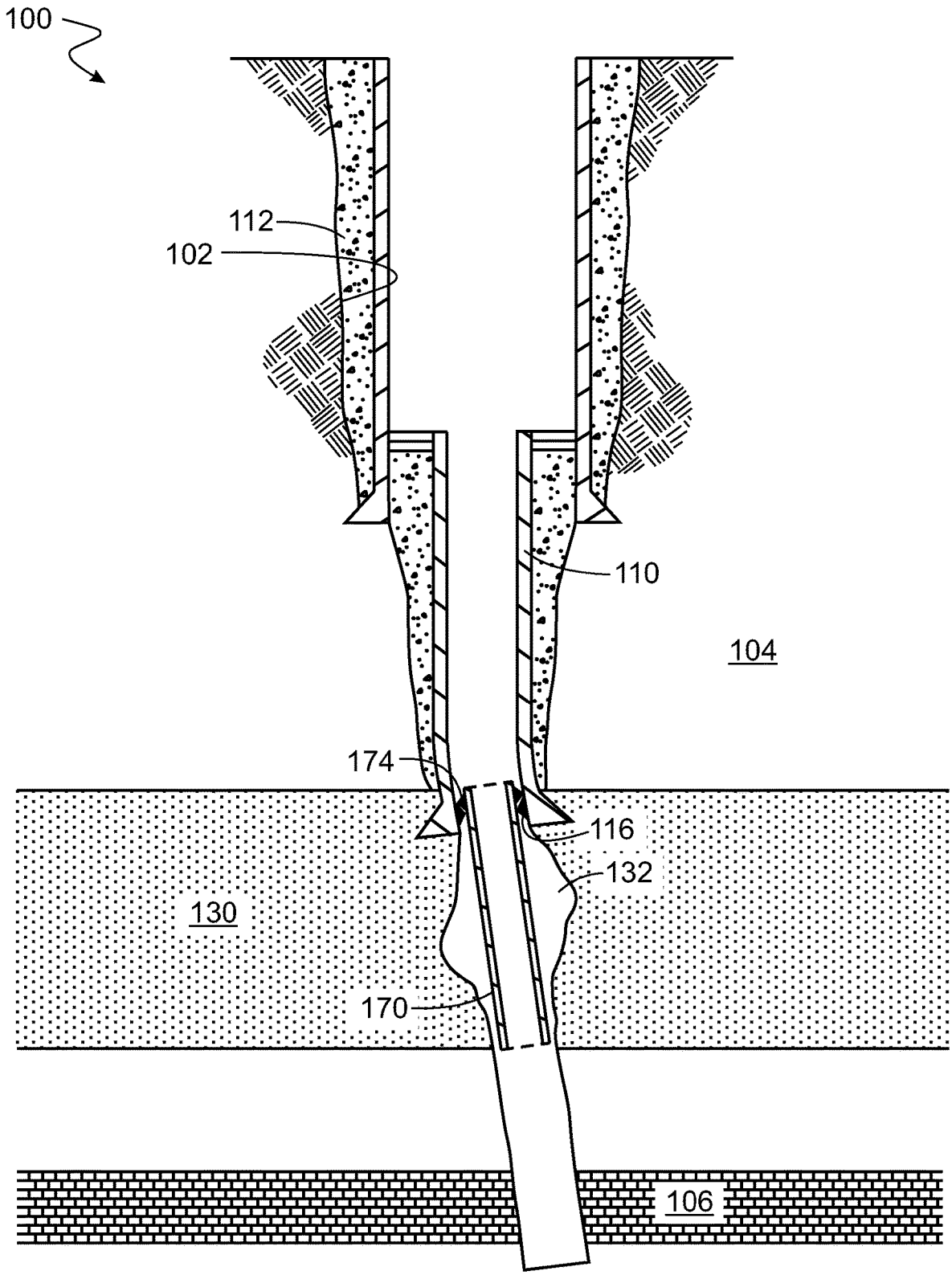
Figure 1E:
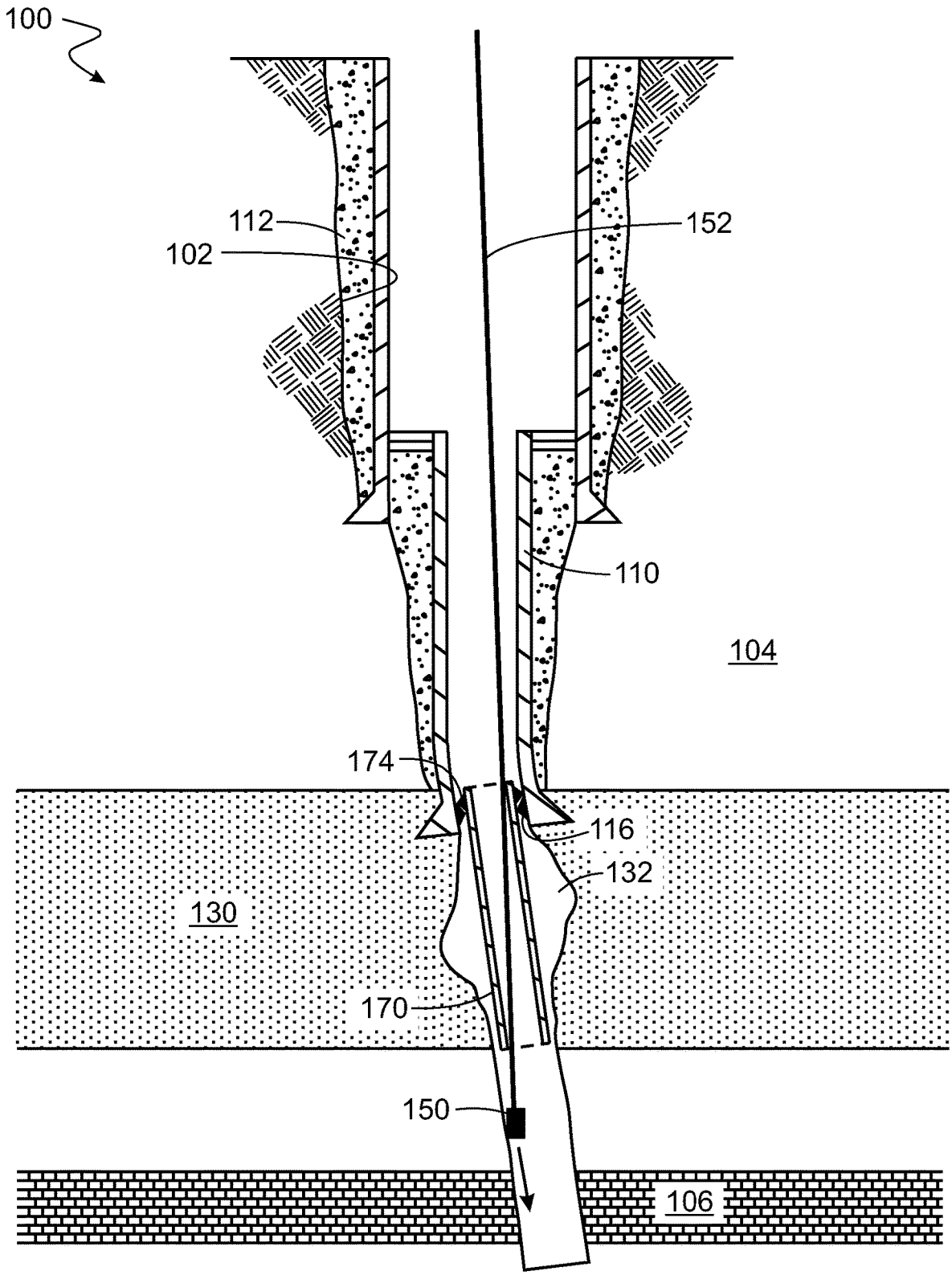
Figure 1F:
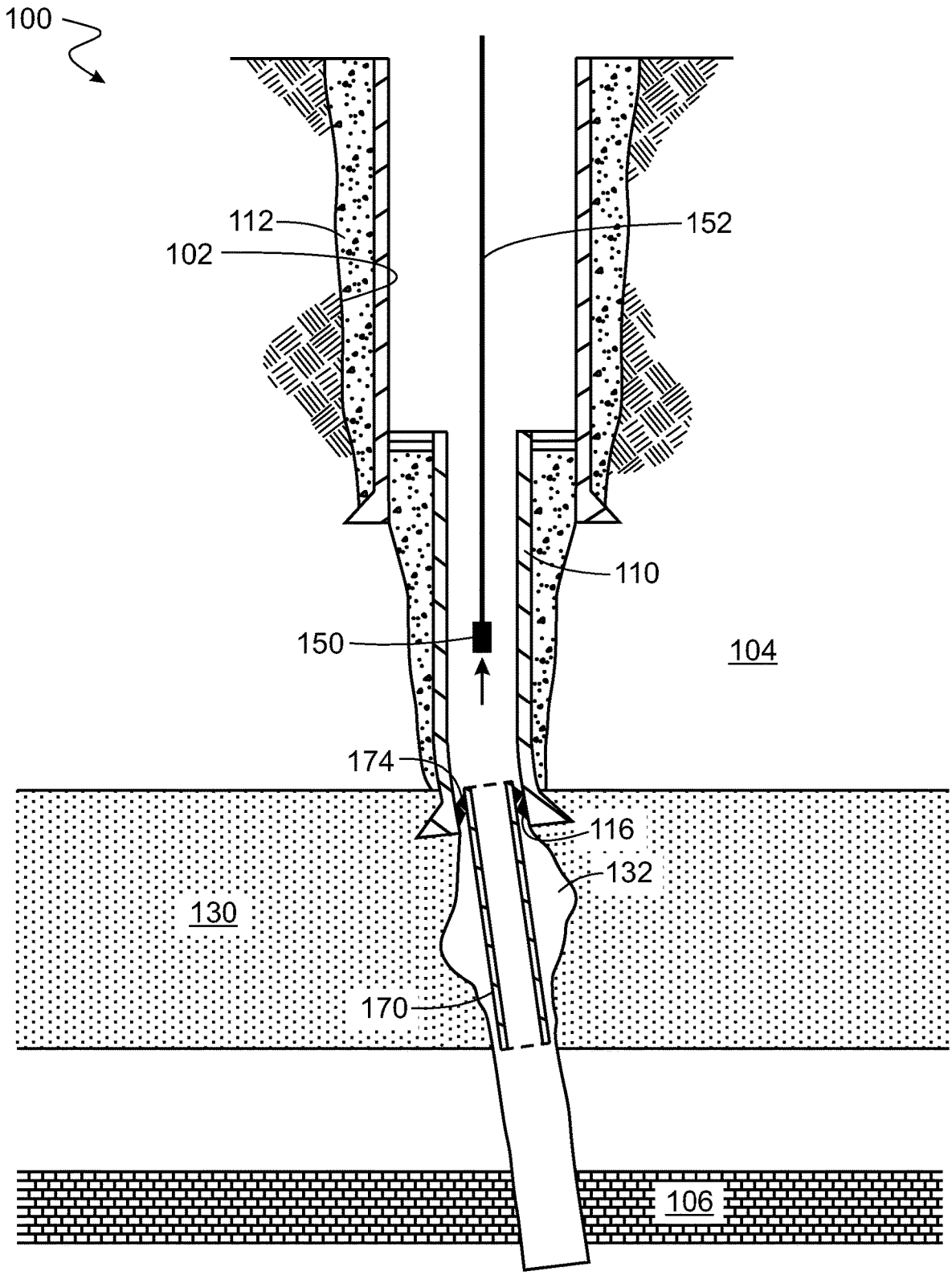
Figure 1G:
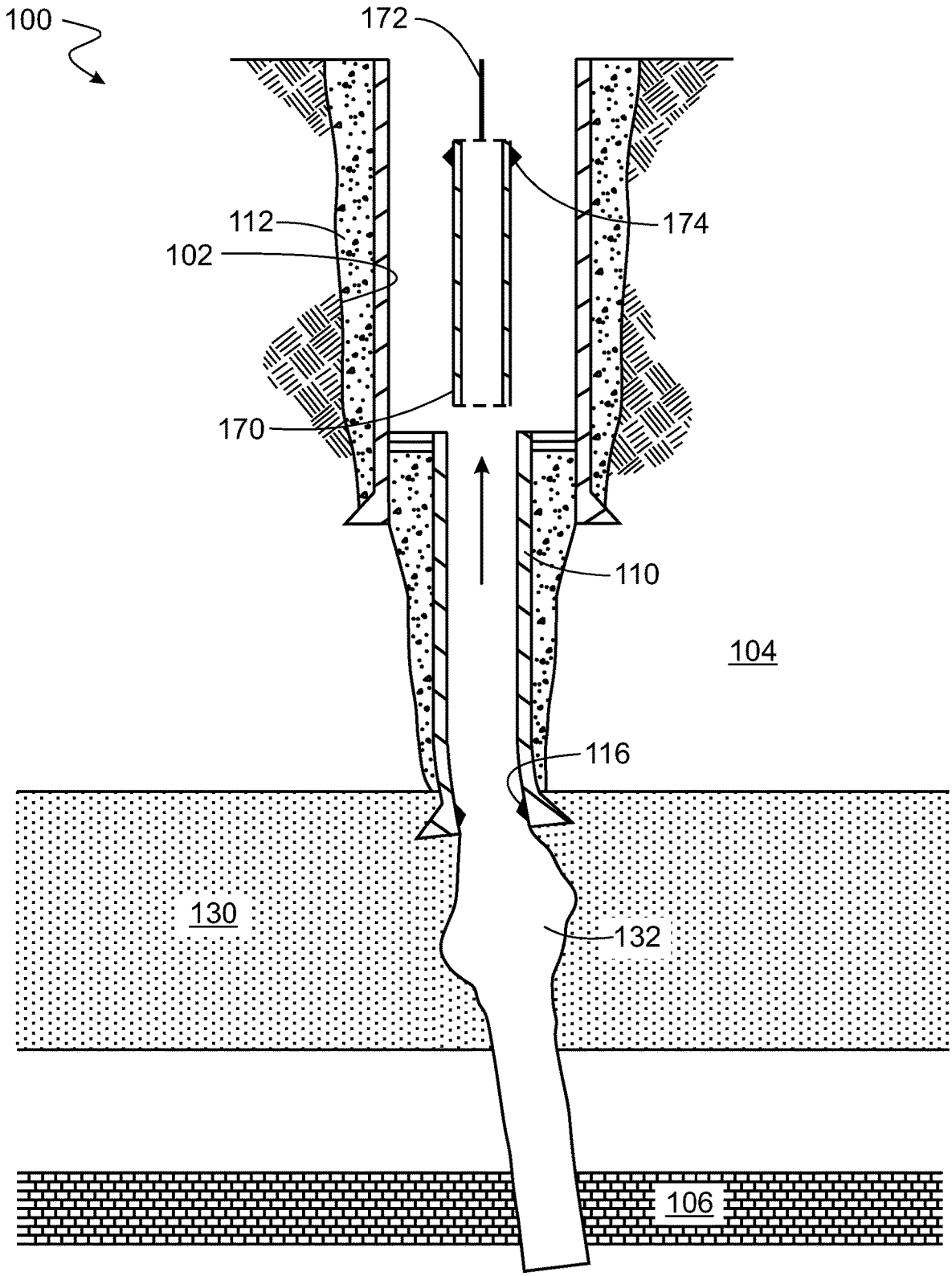
Figure 2:
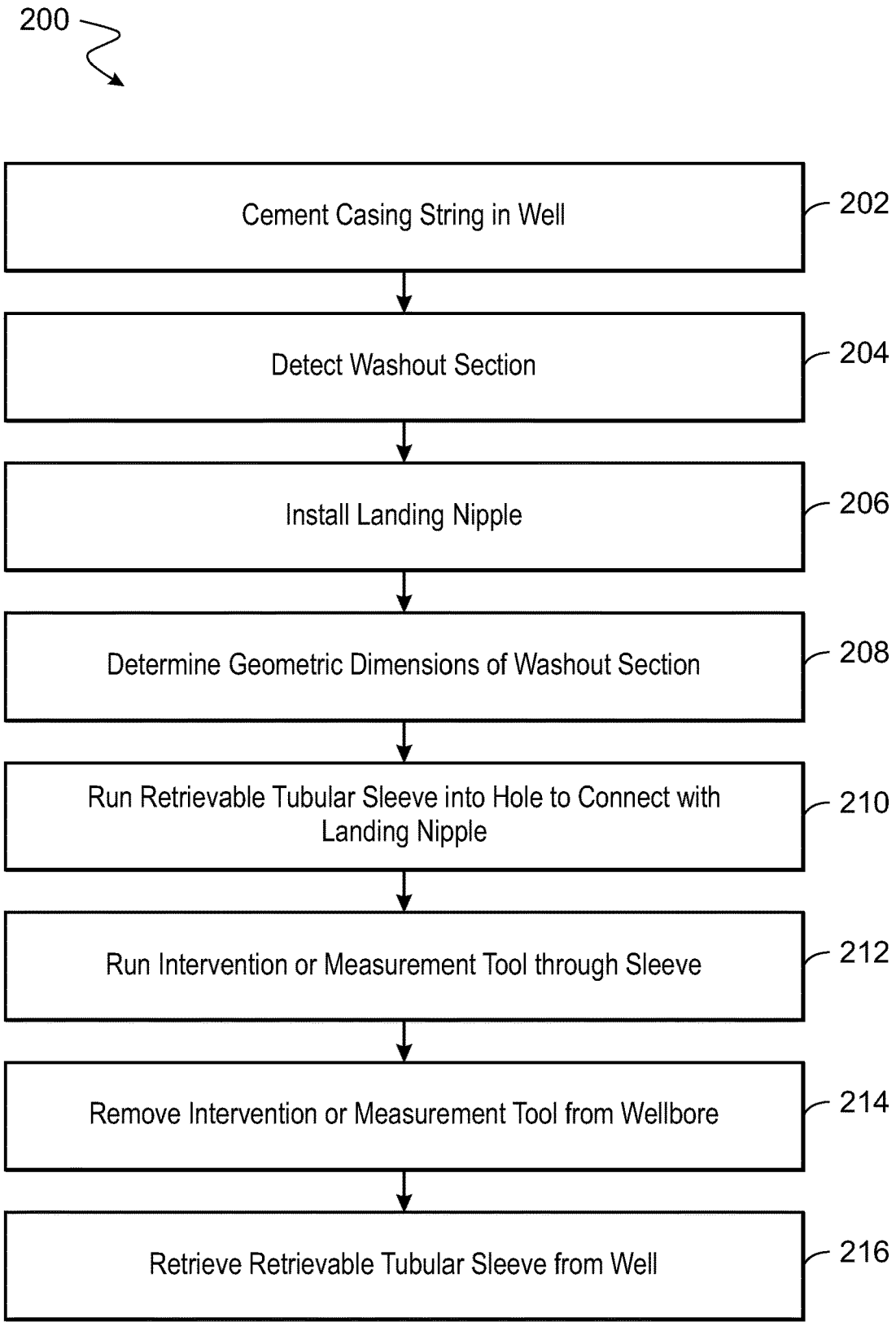
FIG. 2 is a process flow diagram of a method for mitigating a washout section accordance with an embodiment of the present disclosure.

FIG. 2 is a process flow diagram of a method 200 for mitigating the undesirable effects of a washout section, in accordance with an embodiment of the present disclosure. The steps of FIG. 2 will hereafter be described in reference to the systems and apparatus of FIGS. 1B-1G and the corresponding numbered components illustrated therein; however, it will be understood that other tools and other apparatus components and systems can be used in other embodiments of the present disclosure, in the context of various different kinds and types of well systems.

The method begins with step 202 wherein a casing string is positioned and cemented within a wellbore, as shown in FIG. 1A and described above. At step 204, the presence of a washout section 132 is detected (for example, in an open-hole section of a wellbore downhole of a downhole end of casing string 110, as shown in FIG. 1A). Such detection can be via a change in wellbore fluid flow detected at the surface, via an unexpected complication in the lowering of an intervention tool or other component, via a caliper log, or other means. In some embodiments, the shape, length, orientation, surrounding lithologic composition, or other features of washout section 132 can be such that the running of tools or other downhole components (such as intervention or measurement tool 150) can be prevented or made more expensive or otherwise problematic.

At step 206, a landing nipple 116 is installed on an inner surface of casing string 110. In some embodiments, the landing nipple is installed in response to the detection step of 204. In other embodiments, the landing nipple is installed before step 202 (i.e., installed on the casing string before lowering and cementing the casing string or one of its component segments in the wellbore, before or after the presence of the washout zone is detected). In some embodiments, the landing nipple is a no-go nipple, on which a downhole component can be connected by landing the component on a shoulder of the nipple, thus preventing further downhole movement of the component (but from which the component can be released by simply pulling the component in an uphole direction). In some embodiments, the landing nipple is a releasable lock profile, on which a corresponding profile key latches, whereby the downhole component can be connected and locked such that movement of the downhole component is prevented until and unless sufficient force is applied in an uphole or downhole direction (for example, by pulling up on coiled tubing or other conveyance to which the downhole component is attached, which sufficient force to overcome an internal spring that urges the keys into the lock profile). In some embodiments, the landing nipple can be a sting receptacle or another suitable type of landing nipple.

Proceeding to step 208, one or more geometric dimensions of at least a portion of washout section 132 are determined. Such determination can be, for example, via a caliper tool 160 run into the well by a suitable conveyance 162 (such as a slickline or coiled tubing) as shown in FIG. 1B. The geometric dimensions can include, for example, the length 164 of the washout section along the longitudinal axis 166 of wellbore 102, and/or the diameter 168 of wellbore 102 at various points along longitudinal axis 166.

Proceeding to step 210, as shown in FIG. 1C, a retrievable tubular sleeve 170 is run downhole via a suitable sleeve conveyance 172 (such as coiled tubing, slickline, or wireline). Tubular sleeve 170 can include a key profile 174 disposed on an outer surface of tubular sleeve 170 and which can include, for example, a no-go profile or a latch key profile configured to rest upon, lock into, or otherwise connect to landing nipple 116 installed on casing string 110. In some embodiments, outer diameter 176, length 178 along the longitudinal axis, position of key profile 174, and other dimensions and features of tubular sleeve 170 are such that, when key profile 174 is connected to landing nipple 116 as shown in FIG. 1D, at least a portion of retrievable tubular sleeve 170 extends downhole from the downhole end of casing string 110 through all or a portion of the length of washout section 132 (for example, that portion of washout section 132 for which the one or more geometric dimensions have been determined). In some embodiments, the length of retrievable tubular sleeve 170 is sufficient to extend at least the entire length of washout section 132. For example, in some embodiments, retrievable tubular sleeve 170 can have a length along its longitudinal axis of 50 (fifty) feet, one hundred (100) feet, or other suitable length. In some embodiments, sleeve outer diameter 176 is approximately the same as (i.e., only slight less than) the inner diameter 111 of the lowermost portion of casing 110, and the sleeve is constructed and configured such that the thickness of the walls of sleeve 170 is minimized (within requirements to provide required or desired structural strength of the sleeve), such that the inner diameter 175 of sleeve 170 is sufficient to permit the passage therethrough of intervention tools, logging tools, or other desired or necessary apparatus. In the illustrated embodiment, and in contrast to casing string 110, retrievable tubular sleeve is not cemented into the wellbore. Retrievable tubular sleeve 170 can in some embodiments be composed of carbon or stainless steel or another suitable metallic material, a non-metallic composite material, or another suitable material or combinations of materials.

As shown in FIG. 1E, the downhole location and dimensions of retrievable tubular sleeve 170 are such that, at step 212, a downhole device (such as intervention or measurement tool 150) can be lowered downhole through retrievable tubular sleeve 170 and out its downhole end, to a portion of wellbore 102 downhole of washout section 132. Intervention or measurement tool 150 can be conveyed via a coiled tubing, slickline, wireline, tractor, or other suitable conveyance 152 and can be, for example, a well logging tool, pulling tool, shifting tool, or other suitable intervention or measurement tool. Thus, the installation of retrievable tubular sleeve 170 across washout section 132 as shown in FIG. 1E can allow for tool or other apparatus passage when such passage would otherwise be impossible or problematic, and can otherwise allow for improved and more cost-effective well operations, notwithstanding the presence of washout section 132 or other obstructions.

Proceeding to step 214, as shown in FIG. 1F, intervention or measurement tool 150 is removed from wellbore 102. At step 216, as shown in FIG. 1G, retrievable tubular sleeve 170 can be disconnected (for example, by unlatching key profile 174 from landing nipple 116) and removed from wellbore 102 via conveyance 172 or another suitable retrieval apparatus, and well operations can continue.

The term "uphole" as used herein means in the direction along the production tubing or the wellbore from its distal end towards the surface, and "downhole" as used herein means the direction along a tubing string or the wellbore from the surface towards its distal end. A downhole location means a location along the tubing string or wellbore downhole of the surface. "Approximately" or "substantially" as used herein means a deviation or allowance of up to 10 percent (%). Likewise, "about" can also allow for a degree of variability in a value or range, for example, within 10%, within 5%, or within 1% of a stated value or of a stated limit of a range.

In this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

While this disclosure contains many specific implementation details, these should not be construed as limitations on the subject matter or on what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Nevertheless, it will be understood that various modifications, substitutions, and alterations may be made. While operations are depicted in the drawings or claims in a particular order, this should not be understood as requiring that such operations be performed in the particular order shown or in sequential order, or that all illustrated operations be performed (some operations may be considered optional), to achieve desirable results. Accordingly, the previously described example implementations do not define or constrain this disclosure.

The invention claimed is:

1. A method comprising:

determining one or more geometric dimensions of a portion of a washout section of a wellbore, wherein the washout section extends at least partially downhole of a downhole end of a casing string cemented within the wellbore;

running, with a running tool, a retrievable tubular sleeve downhole through the casing string, thereby connecting a key profile disposed on an outer surface of the retrievable tubular sleeve with a landing nipple disposed on an inner surface of the casing string, wherein the retrievable tubular sleeve is dimensioned such that, when the key profile is connected with the landing nipple, a portion of the retrievable tubular sleeve extends downhole from the downhole end of the casing string and within the portion of the washout section for which the one or more geometric dimensions have been determined;

running an intervention or measurement tool through the retrievable tubular sleeve into a portion of the wellbore below a downhole end of the washout section removing the intervention or measurement tool from the wellbore; and removing the retrievable tubular sleeve from the casing string after the intervention or measurement tool has been removed from the wellbore.

2. The method of claim 1, wherein the one or more geometric dimensions determined comprises a diameter of the wellbore at a point along a longitudinal axis of the wellbore within the washout section.

3. The method of claim 1, wherein the one or more geometric dimensions determined comprises a length of the washout section along a longitudinal axis of the wellbore and wherein the tubular sleeve is dimensioned such that its downhole end is further downhole along a longitudinal axis of the wellbore than a downhole end of the washout section when the key profile is connected with the landing nipple.

4. The method of claim 1, wherein the retrievable tubular sleeve is comprised of a metallic material.

5. The method of claim 1, wherein the landing nipple comprises a releasable lock profile.

6. The method of claim 1, wherein the landing nipple comprises a no-go profile.

7. The method of claim 1, wherein the retrievable tubular sleeve is run downhole by coiled tubing.

8. The method of claim 1, wherein the retrievable tubular sleeve is run downhole by a slickline.

9. The method of claim 1, wherein the retrievable tubular sleeve is not cemented into the wellbore.

10. The method of claim 1, wherein an inner diameter of the retrievable tubular sleeve is dimensioned so as to permit passage therethrough of an intervention tool.

11. The method of claim 1, wherein an inner diameter of the retrievable tubular sleeve is dimensioned so as to permit passage therethrough of a logging tool.

12. The method of claim 1, wherein the landing nipple is affixed to the casing string after the casing string has been cemented within the wellbore.

13. The method of claim 1, wherein the landing nipple is affixed to the casing string before the casing string is disposed in the wellbore.

* * * * *